United States Patent [19]

Schneider

[11] 4,389,860

[45] Jun. 28, 1983

[54] WARP KNITTING MACHINE FOR THE PRODUCTION OF JACQUARD-PATTERNED PILE-KNIT FABRICS

[75] Inventor: Manfred Schneider, Karl-Marx-Stadt, German Democratic Rep.

[73] Assignee: Textima VEB Wirkmaschinenbau Karl-Marx-Stadt Kombinat Textima, Karl-Marx-Stadt, German Democratic Rep.

[21] Appl. No.: 254,392

[22] Filed: Apr. 15, 1981

Related U.S. Application Data

[63] Continuation-in-part of Ser. No. 40,051, May 17, 1979.

[30] Foreign Application Priority Data

Jun. 8, 1978 [DD] German Democratic Rep. ... 205858

[51] Int. Cl.[3] ..... D04B 23/06

[52] U.S. Cl. ..... 66/84 R

[58] Field of Search ..... 66/203, 204, 84 R

[56] References Cited

U.S. PATENT DOCUMENTS 3,707,853 1/1973 Linder et al. ..... 66/84 R

FOREIGN PATENT DOCUMENTS 8635 of 1840 United Kingdom ..... 66/203

*Primary Examiner*—Ronald Feldbaum

*Attorney, Agent, or Firm*—Michael J. Striker

[57] ABSTRACT

The warp knitting machine for jacquard-patterned pile-knit fabrics includes pile yarn carriers which are individually movable, according to a selected pattern, in the place of each needle to form a shed of the selected pattern forming and the non-selected pile yarns whereby the tip of the shed is at the knock-over point of the needle. A guide reed is movably arranged between the pile yarn carriers and a pile sinker and includes a laying edge which crosses the pattern-forming pile yarn of the shed. The guide reed performs lateral and sinking movement to overlay the selected pile yarn.

15 Claims, 5 Drawing Figures

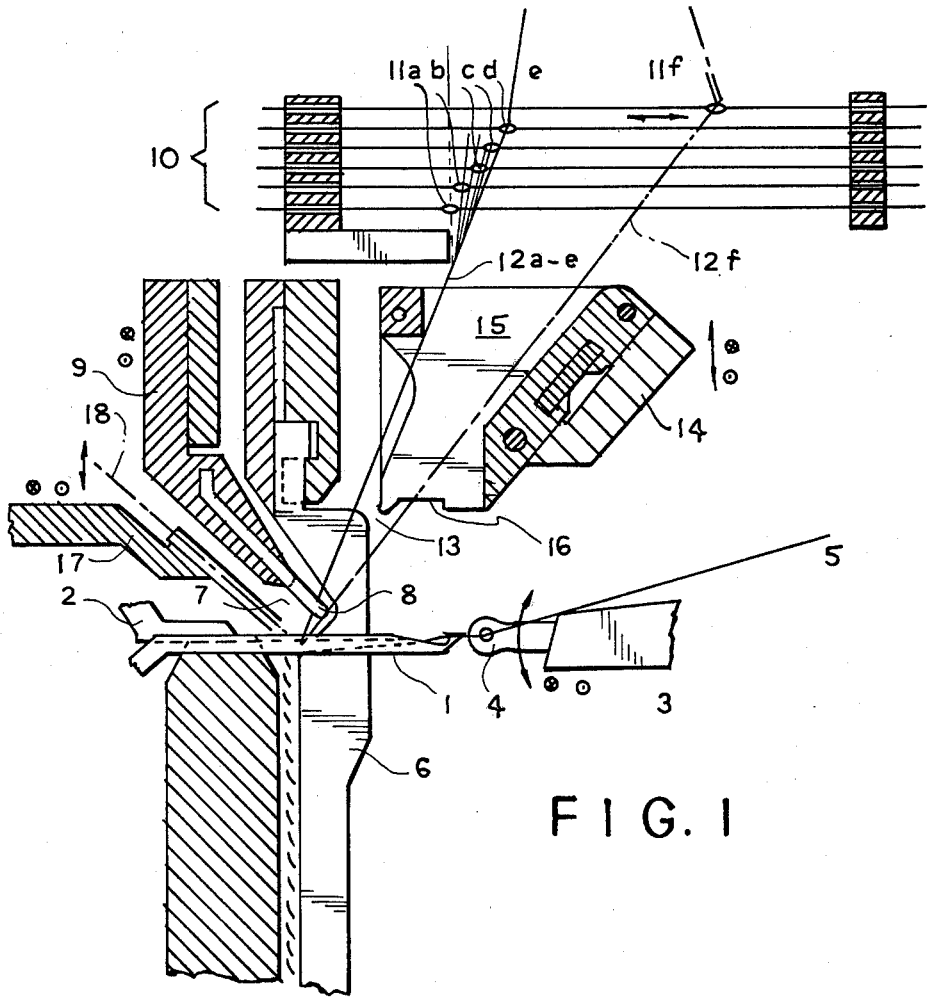
FIG. 1
FIG. 2
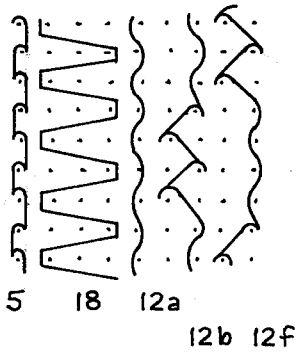

FIG. 4
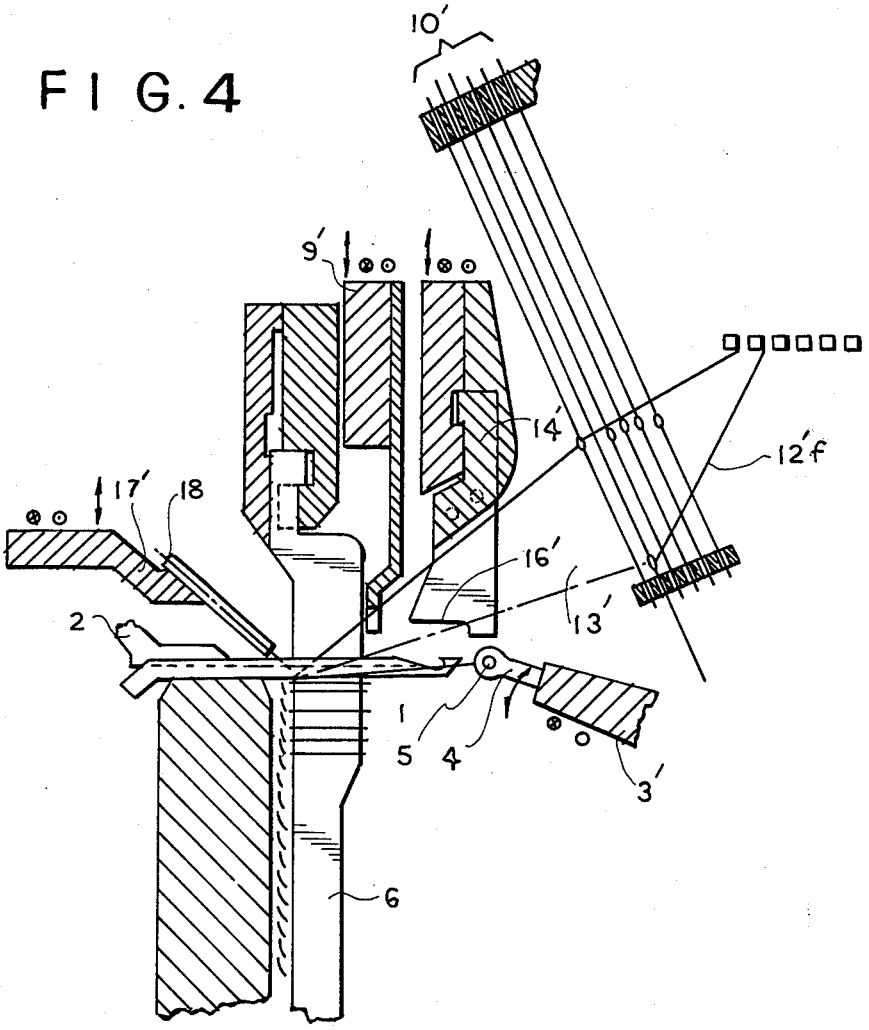
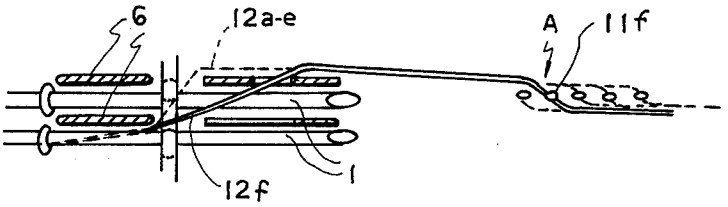
FIG. 3

WARP KNITTING MACHINE FOR THE PRODUCTION OF JACQUARD-PATTERNED PILE-KNIT FABRICS

This application is a continuation-in-part of Ser. No. 040,051, filed May 17, 1979.

BACKGROUND OF THE INVENTION

The invention relates to warp knitting machines having one row of needles with warp yarn carriers and weft yarn carriers for the base fabric construction, as well as with several pile yarn carriers assigned to one needle, one of the pile yarns forming loops over these pile sinkers being tied-in as stitch, and the non-pattern-forming pile yarns being tucked, in alternating directions, under their needles as standing weft.

It is known how to arrange in a warp knitting machine with pile sinkers, multiple pile yarn carriers within the angle between the pile sinkers and the breast of the needle when in clearing position, the exit openings of the pile yarn carriers being about parallel to the stem of the needle. Yarn selectors with their throat open towards the needle, are assigned to these exit openings, which also, according to the pattern can be assigned each to one yarn exit opening and which can be lowered, in every second row, to a position below the needle hook. The multiple yarn carrier can be racked between the rows of needles, in every second row of stitches (GDR Pat. Nos. 110 073, 119,275).

This device allows the manufacture with highest productivity, of a Jacquard-patterned knit pile of appropriate fine gauge.

The nearly untwisted synthetic material for the pile yarn suitably used herein, will lead to defects in the selection of the pile yarn by the yarn selector, especially with a larger number of pile yarn per wale, and where on clearing the needles penetrate the tow of pile yarn. The results are either defects in the pattern or defects in the entire tying. Knit pile especially of multi-ply yarn or of a higher fineness will be of poorer quality.

SUMMARY OF THE INVENTION

The objective of the invention consists in improving the quality of the product and thus considerably enlarging the field of application of this method.

Another objective of the invention is to distinctly separate the pattern-forming and non-pattern-forming pile yarn in every phase of the knitting process and to guide the tow of pile yarn during clearing of the needles in such a manner that unsplicing of the pile yarn by the needle is precluded. As per invention, this task is solved by having the pile yarn carriers individually movable, according to the pattern, in the plane of the respective needle stems so that the pattern-forming and non-pattern-forming pile yarn form a shed, the tip of which is facing the knock-over point, by providing between the pile yarn carriers and the pile sinkers a guide reed crossing the shed, by having above the respective pattern-forming pile yarn its sinkers provided with an insertion edge set about parallel to the needle breast, with the reed performing a lateral racking movement for the overlap of the pattern-forming pile yarn.

According to a first version of the design, the shed is formed entirely in front of the breast side of the row of needles, wherein the plane of the non-pattern-forming pile yarn is spaced from the row of needles at a greater distance than the plane of the pattern forming pile yarn, with the insertion edge of the guide reed located between the plane of the two pile yarns, and the knitting yarn guide being arranged between the row of needles and the plane of the pattern-forming pile yarns. In this design version, a guide comb is suitably arranged, immediately in front of and parallel to the pile sinkers, laterally movable and also immediately ahead of the row of needles.

This guide comb ensures lateral guiding for the pile yarn upon the clearing of the needles and it can lower the pile yarn below the row of needles so far that they can swivel, nearly in parallel, through the space between the needles.

A particularly advantageous arrangement of the guide comb will result when the teeth of the guide comb are set in the rearward recesses of the pile sinkers, immediately ahead of the needle stem and where the recess in the pile sinkers will reach until immediately ahead of the typing-in position of the non-pattern-forming pile yarn.

Another version of the design provides for a shed of the pile yarn in the plane of the needles, where the plane of the non-pattern-forming pile yarn is arranged in the back of the row of needles and the knitting-yarn carrier will reach through this plane of the pile yarn at points displaced in the direction of racking.

In this case, the guide comb is replaced by a stationary guide bar and will continually allow the forming of an exactly defined shed.

In both versions of the design the guide reed can, apart from racking, also move across the row of needles, thus making for safe insertion of the pile yarn into the needle hook. The pile-yarn guides are suitably designed as heddles as known from Jacquard weaving. They are also controlled, in the manner known per se, by Jacquard selectors of all known types. Use of non-bending sinkers can also be envisioned. It is suitable to choose such a Jacquard device which will perform a new selection after every second stroke of the lifting bar. The invention is also suitable for warp knitting machines with pile sinkers that can be racked sidewise.

BRIEF DESCRIPTION OF THE DRAWING

The invention is to be explained closer herein below with a few examples of the design. In the drawings are shown:

FIG. 1 a section through the knitting point of a first version of the pile knitting machine;

FIG. 2 a lap scheme;

FIG. 3 a schematic representation of the course of the pile yarn in a top view onto the stitch-forming point;

FIG. 4 a second version of the knitting point, in section; and

DESCRIPTION OF THE PREFERRED EMBODIMENTS

Figure 5:
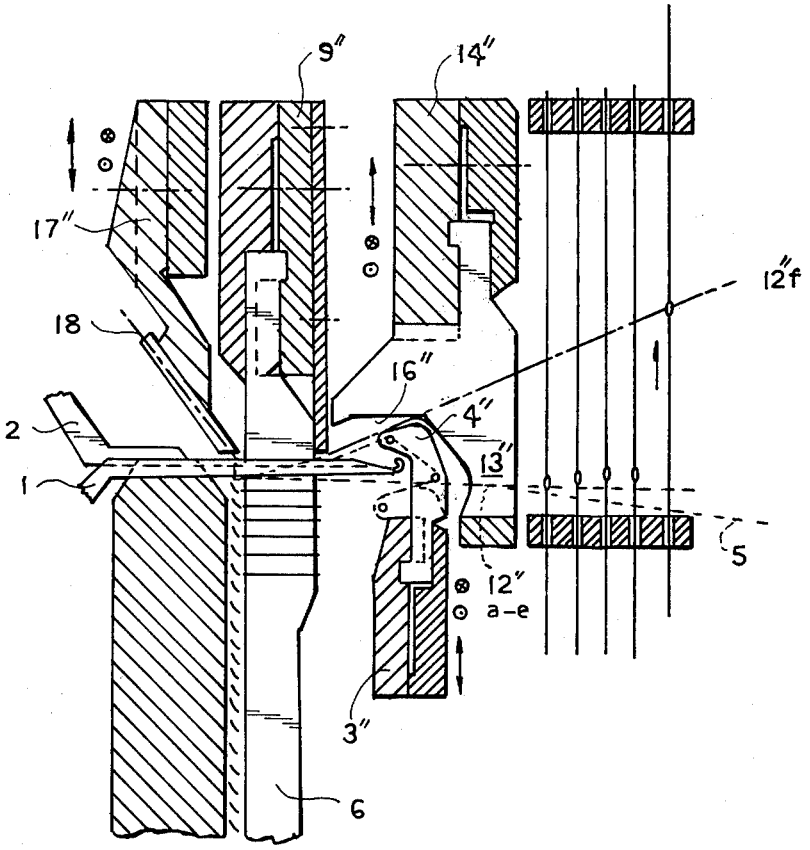
FIG. 5 a third version of the knitting point.

The warp knitting machine is equipped with sliding needles 1 working in conjunction with the controlled slides 2. A lap bar 3 with knitting yarn carriers 4 for the knitting yarn 5, is arranged in the plane of the needles.

The lap rail or bar 3 performs fringe lapping. Pile plates or sinkers 6, reaching through the row of needles, are arranged vertically to the needles. The pile sinkers 6 have a recess 7 which is opened toward the knock-over side. The teeth 8 of a guide comb 9 reach into this recess 7, which can be racked laterally according to the knitting rythm. Located above the knitting point and about parallel to the row of needles, is the shed-forming mechanism with the heddles 10.

In the eyes of the heddles 10 are the pile-yarn carriers 11. A group of pile-yarn carriers 11*a* to 11*f* is assigned to every needle. The heddles are individually driven as in Jacquard weaving, by a Jacquard device as known per se, wherein the heddles 10, which guide the pattern-forming pile yarn 12*f* are racked into the position A while the pile-yarn carriers 11*a* to 11*e*, carrying the non-pattern-forming pile yarn 12*a* to 12*e*, remain in position B. A guide reed 14 is arranged in the zone of the shed 13 formed by the pile yarn, between the row of needles 1 and the heddles 10, which can be moved in the direction of the needles and in the direction of racking. The sinkers 15 of the guide reed 14 reach completely through the shed 13, and having a lap edge 16 reaching at least partially into the shed 13, the sinkers 15 are essentially aligned parallel to the stem of the sliding needles 1. A weft guide bar 17 is arranged beyond the pile sinkers 6 and will lap a partial weft 18 for the base fabric construction. This device works as follows:

When the sliding needle 1 is in the knock-over position, the partial weft 18 is laid under the needle hook. The guide comb 9 is racked in such a manner that the pile yarn 12 will be led to the right or to the left of the needle for the purpose of being tucked under the dead pile, and pricking of the pile yarn 12 is avoided. In the meantime, the pattern-forming pile yarn 12*f* is moved by the pile yarn carrier 11*f* into the position A. On further drive of the needles 1, the guide reed 14 is racked laterally in a first direction, by 1.5 of the needle spacing and then lowered in the direction of the needles.

The lap bar 3 is racked and lowered. The laying edge 16 grips the pattern-forming pile yarn 12*f* and places it into the needle hook. The needle 1 begins the knock-over movement and forms a stitch from the pile yarn 12 and the knitting yarn 5. While the sinker stitch of the pattern forming pile yarn 12, is lapping over the pile sinker 6 and forms the pile loop, the knitting yarn will tie-in, as standing weft, partial wefts 18 and the non-pattern-forming pile yarn 12 (compare FIG. 2). In the next stitch-forming cycle, the sequence is repeated wherein it is possible to rack again the guide reed into the same direction before racking in the opposite direction takes place.

The second version of design differs from the version already described only in the shed 13 being laid flatter to the axis of the needle in order to provide for a more favourable gripping of the pattern-forming pile yarn by the laying edge 16' of the guide reed 14'. Herein the guide comb 9' is arranged before the pile sinkers 6' and can be lowered until it is below the needles 1, in order to prevent prick of the non-pattern-forming pile yarns 12'*a* to 12'*e*, by the needle 1.

It is however possible also in this version to arrange the guide comb 9 beyond the pile sinkers 6, in a recess 7.

In a third variant FIG. 5 the shed 13'' is so formed that the non pattern-forming pile yarn 12''*a–e* will continually remain below the plane of the needles and only the pattern-forming pile yarn 12''*f* will be produced before the needle breast. The guide reed is also reaching across the entire shed 13''. It differs from the variants described afore, by the laying edge 16'' arranged outside of the shed 13'', i.e. above the pattern-forming pile yarn 12''*f*. In order to tie-in the non-pattern-forming pile yarn as standing weft, the knitting yarn carrier 4'' will penetrate from below the tow of these pile yarns 12'', lay the knitting yarn 5 into the needle hook, and will then escape again below.

After racking of the non-pattern-forming pile yarn by the guide reed 14'', the knitting-yarn carrier will penetrate through another gap, and anew insert thread into its needle. By this, the pile yarn 12'', skipped in the respective instance, are tied in as standing weft.

Pricking of the non-pattern forming pile yarn 12'' by the needles 1 is completely precluded. The advantages of this device as per invention consist above all in certain separation of the pile yarn during every cycle, also in case of higher finenesses and/or a higher number of pile yarns per needle.

What is claimed as new and desired to be protected by Letters Patent is set forth in the appended claims:

1. Warp knitting machine for the production of Jacquard patterned knit-pile fabrics, comprising a row of slide needles each having a needle stem and a needle hook; a guide bar including knitting yarn carriers; a plurality of pile yarn carriers assigned to each needle; means for the selection of the respective pattern forming pile yarn; means for tucking the non-selected pile yarns; means for inserting the selected pattern forming pile yarn into a needle hook; pile sinkers for holding the pile loop formed between successive rows of stitches; said pile yarn carriers being movable relative to each other so that the selected pattern forming pile yarn forms with the non-selected pile yarns a shed, the tip of which is located at the knock-over point in the plane of respective needle stems; and a guide reed having sinkers provided respectively with an insertion edge, extending in parallel to said needles, said reed being arranged between said pile yarn carriers and said pile sinkers to cross said shed and to perform a lateral racking movement so that said edge overlays said pattern forming pile yarn.

2. Warp knitting machine defined in claim 1 wherein the shed of the pile yarns is arranged ahead of said needles, the non-selected pile yarns being spaced apart from the row of needles at a greater distance than the respective pattern-forming pile yarn, and the knitting yarn carrier being arranged between the plane of the pattern-forming pile yarns and the row of needles.

3. Warp knitting machine as defined in claim 1 wherein the pile yarn carriers are movable substantially at right angles, to the row of needles.

4. Warp knitting machine as defined in claim 1 wherein the pile yarn carriers are movable parallel to the row of needles.

5. Warp knitting machine as defined in claim 1 wherein said pile sinkers are formed with recesses and said tucking means include a guide comb movable within the zone of said recesses in the longitudinal direction of the row of needles, said comb including teeth for guiding said pile yarn.

6. Warp knitting machine as defined in claim 5 wherein the guide comb has a guide edge extending parallel to the row of needles and being sinkable to a level at which said guide edge is below the row of needles.

7. Warp knitting machine as defined in claim 5, wherein the teeth of the guide comb are arranged within said recesses on the knock-over side of the pile sinkers immediately ahead of the row of needles, and the recesses reaching up to the lower side of the needles.

8. Warp knitting machine as defined in claim 1 wherein the shed of the pile yarns is formed in the plane of the needles, the plane of the pile yarn of the non-pattern-forming pile yarns being arranged in the back of the row of needles, and the knitting yarn carrier reaching through this plane of the pile yarns to points which have been transposed in the direction of racking.

9. Warp knitting machine as defined in claim 1 wherein said tucking means include a guide bar which is directed between the breast of the needles and the pile sinker.

10. Warp knitting machine as defined in claim 1 wherein by the guide reed performs an additional movement vertically to the row of needles, in the direction of the needle hook.

11. Warp knitting machine as defined in claim 1 wherein the pile yarn carriers being in the form of heddles and said selection means being a Jacquard selection device controlling said heddles.

12. Warp knitting machine as defined in claim 11 wherein said heddles include rigid plates and guide means arranged in front of the needle breast.

13. Warp knitting machine as defined in claim 11 wherein the Jacquard selection device actuates the pile yarn carriers after every second stroke of the bar.

14. Warp knitting machine as defined in claim 1, wherein the pile sinkers perform lateral racking.

15. Warp knitting machine as defined in claim 1 wherein the pile sinkers are constructed of two parts whereby a part is situated in the direction of the clearing movement of the needles and is adjustable in the direction of the needle movement.

* * * * *